United States Patent [19]

McCann et al.

[11] Patent Number: 4,928,854

[45] Date of Patent: May 29, 1990

[54] SUPERFLOW DIFFUSER AND SPOUT ASSEMBLY

[75] Inventors: Gerald P. McCann, Los Angeles; Andrew J. Holoubek, Burbank, both of Calif.

[73] Assignee: Mc Cann's Engineering and Manufacturing and Co., Los Angeles, Calif.

[21] Appl. No.: 195,947

[22] Filed: May 19, 1988

[51] Int. Cl.[5] ..... B67D 5/56; B05B 15/02

[52] U.S. Cl. ..... 222/129.1; 222/145; 222/148; 239/419.3; 239/432; 239/106

[58] Field of Search ..... 222/129.1–129.4, 222/148, 481, 488, 145; 239/419.3, 419, 424, 422, 427.3, 427.5, 432, 106

[56] References Cited

U.S. PATENT DOCUMENTS

| | | | |
|---|---|---|---|
| 1,329,601 | 2/1920 | Hinsdale | 239/106 |
| 3,423,028 | 1/1969 | Stupakis | 239/419.3 |
| 3,717,284 | 2/1973 | Garrard | 222/129.1 |
| 3,898,861 | 8/1975 | McMillin | 222/148 |
| 3,966,091 | 6/1976 | Bencic | 222/129.1 |
| 4,218,014 | 8/1980 | Tracy | 239/106 |
| 4,270,673 | 6/1981 | Rodth | 222/129.1 |
| 4,765,513 | 8/1988 | McMillin et al. | 222/148 |

*Primary Examiner*—Joseph J. Rolla
*Assistant Examiner*—Steven Reiss
*Attorney, Agent, or Firm*—Lyon & Lyon

[57] ABSTRACT

A superflow diffuser and spout assembly includes an inlet for carbonated water, an inlet for syrup, a diffuser assembly through which the carbonated water passes prior to being dispensed, a spout, a syrup distributor, and a flow separator within the path of the carbonated water, the flow separator being operative to separate the carbonated water into at least two streams, one stream directed to flow along an outside surface of the spout, the second stream directed to flow inside the spout, the second stream colliding with and mixing with syrup distributed within the spout, wherein the first stream of carbonated water and the second stream of carbonated water, then mixed with syrup, meet and form a single stream for dispensing. A second embodiment includes a syrup distributor having a plurality of inlets for different flavored syrups and a shroud located within the spout between the syrup distributor and an inner surface of the spout. The shroud may be adapted for use with the single syrup flavor embodiment of the present invention.

19 Claims, 1 Drawing Sheet

SUPERFLOW DIFFUSER AND SPOUT ASSEMBLY

FIELD OF THE INVENTION

This invention relates to improvements in diffusers and spout assemblies, and, in particular, the development of diffusers and spout assemblies which are useful to dispense carbonated drinking liquids, such as soft drinks, at flow rates substantially greater than flow rates available from existing diffusers and spout assemblies with an attendant improvement in the quality of the drink.

BACKGROUND OF THE INVENTION

In the vending machine and soft drink dispensing industry it is well known that a basic problem exists with regard to increasing the flow rate of dispensed liquids above the standard one and one-half to three ounces per second. This basic problem manifests itself in excessive foaming of the drink, which causes spillage and overflow. In addition, excessive foaming reduces the efficiency of the operator responsible for dispensing the drinks, because excessive foaming requires the operator to terminate the filling cycle early to permit foam reduction, then re-initiate the filling cycle to "top off" the drink.

Nevertheless, it is desirable that flow rates be maximized to reduce the time required to dispense the soft drink, thus providing improved customer service or reducing the number of attendants required at the work station. Increased flow rate drink dispensers are particularly desirable at high-volume operations such as movie theaters and amusement parks.

Conventional diffusers and spouts used with existing dispensing equipment do not function well when scaled up to flow rates of 5 ounces per second or more. Using conventional equipment, when the flow rate is increased to in excess of 3 ounces per second undesirable hissing occurs at the spout or excessive foaming results from the mixing that occurs between the carbonated water and the syrup. Furthermore, of high flow rates quality of the drink is known to decrease because of stratification of the syrup or excessive loss of carbon dioxide.

It is known that high pressure carbonated water, typically in the range of 60–120 PSIG, used with conventional dispensing equipment, must gently be reduced to atmospheric pressure so as to lose a minimum of carbon dioxide. In existing equipment the methods of pressure reduction result in excessive out-gassing of the carbon dioxide at high flow rates, thus causing excessive foaming of the drink with the attendant reduction in efficiency of the operator and waste of the product. Also, this excessive out-gassing results in a "flat" drink.

Various methods have been previously devised to reduce foaming of the drink yet attempt to maintain the quality of the drink. The most conventional method to reduce foaming of the drink is to provide a restricted passage in the flow, thus reducing the velocity of the carbonated water. However, by placing a restriction in the line the flow rate is substantially reduced to undesirable levels. In other dispensing devices a coiled feed line is provided to reduce foaming of the dispensed soft drink. Alternatively, it is possible to provide a series of chambers which are operative to reduce the pressure of carbon dioxide in the water at various stages in the diffuser and spout assembly. However, this approach has led to an excessive out-gassing of the carbon dioxide, thus resulting in an undesirable reduction in the quality of the dispensed drink.

Existing diffusers and spout assemblies normally contain an inlet for the carbonated water and an inlet for the syrup. These inlets open into chambers which eventually meet at a common mixing chamber. The common mixing chamber opens into a spout for dispensing of the carbonated water/syrup mixture. A pressure reduction occurs at the first chamber, where the carbonated water or syrup is introduced, again at the mixing chamber and again at the spout. Thus, in conventional diffusers and spout assemblies pressure reduction occurs generally at only 2 or 3 locations, the result being a limitation in the potential flow rate, or if the chambers are made large enough to facilitate higher flow rates, an undesirable out-gassing of carbon dioxide from the carbonated water.

OBJECT AND SUMMARY OF THE INVENTION

It is a general object of the present invention to provide a new and improved diffuser and spout assembly capable of dispensing carbonated liquids at flow rates far in excess of those presently achievable.

Another object of the present invention is to provide a superflow diffuser and spout assembly which provides multiple stages of pressure reduction while achieving increased flow rates yet maximizes carbon dioxide retention with an attendant reduction in foaming of the dispensed drink.

Another object of the present invention is to provide a superflow diffuser and spout assembly which will improve mixing of the syrup with carbonated water to achieve a higher quality drink.

Another object of the present invention is to provide a superflow diffuser and spout assembly which has self-cleaning capabilities.

Another object of the present invention is to provide a superflow diffuser and spout assembly which has the capability of dispensing multiple flavors with a self-cleaning capability.

Another object of the present invention is to provide a superflow diffuser and spout assembly capable of dispensing carbonated drinks at higher temperatures with increased flow rates.

Another object of the present invention is to provide a superflow diffuser and spout assembly which is capable of dispensing multiple flavors at higher flow rates than presently achievable.

Another object of the present invention is to provide a superflow diffuser and spout assembly which will dispense carbonated liquids at higher flow rates, with attenuated noise, than presently achievable.

Another object of the present invention is to provide a superflow diffuser and spout assembly which is capable of variable flow rates based upon the design of a diffuser assembly within the diffuser and spout assembly.

Another object of the present invention is to provide a superflow diffuser and spout assembly which improves mixing of the syrup with the carbonated water at higher than conventional flow rates.

Another object of the present invention is to provide a superflow diffuser and spout assembly which reduces out-gassing of carbon dioxide from the carbonated water resulting in improved drink quality.

The superflow diffuser and spout assembly of the present invention includes, in summary, an inlet for carbonated water, an inlet for syrup, a diffuser assembly through which the carbonated water flows prior to being dispensed, a syrup distributor, a spout, and a flow-separator within the path of the carbonated water, wherein the flow separator is operative to separate the carbonated water into at least two streams, a first stream directed to flow along an outside surface of the spout, the second stream directed to flow inside the spout, the second stream colliding with and mixing with syrup distributed inside the spout, wherein the first stream of carbonated water and the second stream of carbonated water, then mixed with syrup, meet and form a single stream for dispensing.

In a second embodiment of the super flow diffuser and spout assembly of the present invention, a syrup distributor is constructed to introduce different flavored syrups through a plurality of inlets, which will separately cause syrup to mix with carbonated water in a spout for dispensing. The second embodiment of the present invention includes a fitted shroud located within the spout between the syrup distributor and an inner surface of the spout, the shroud operative to facilitate cleansing of the inner surface of the spout to eliminate the possibility of residual syrup mixing with later-dispensed syrup of a different flavor. The shroud, adaptable for use with either the single flavor or multiple flavor embodiments of the present invention, is also operative to reduce the velocity of the distributed syrup resulting in a more gentle mixing of the syrup and carbonated water to reduce foaming.

The foregoing and additional objects and features of the present invention will become apparent from the following description, in which the preferred embodiment has been set forth in detail, in conjunction with the accompanying drawings.

DESCRIPTION OF THE PREFERRED EMBODIMENT

Figure 1:
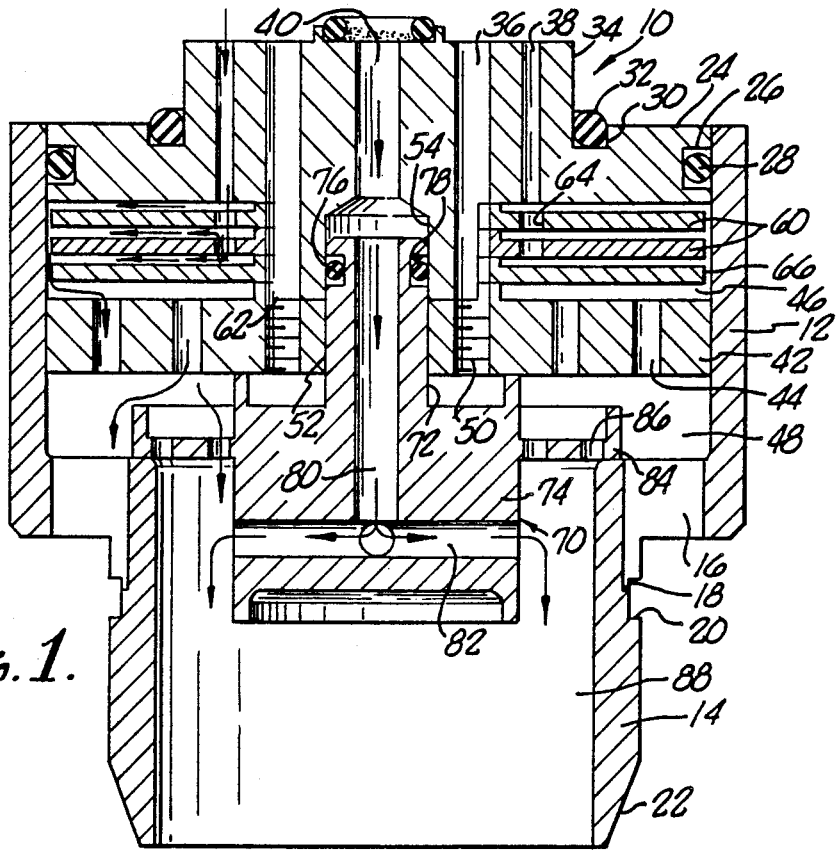
FIG. 1 is a side cross-sectional view of the superflow diffuser and spout assembly of the present invention.
Figure 2:
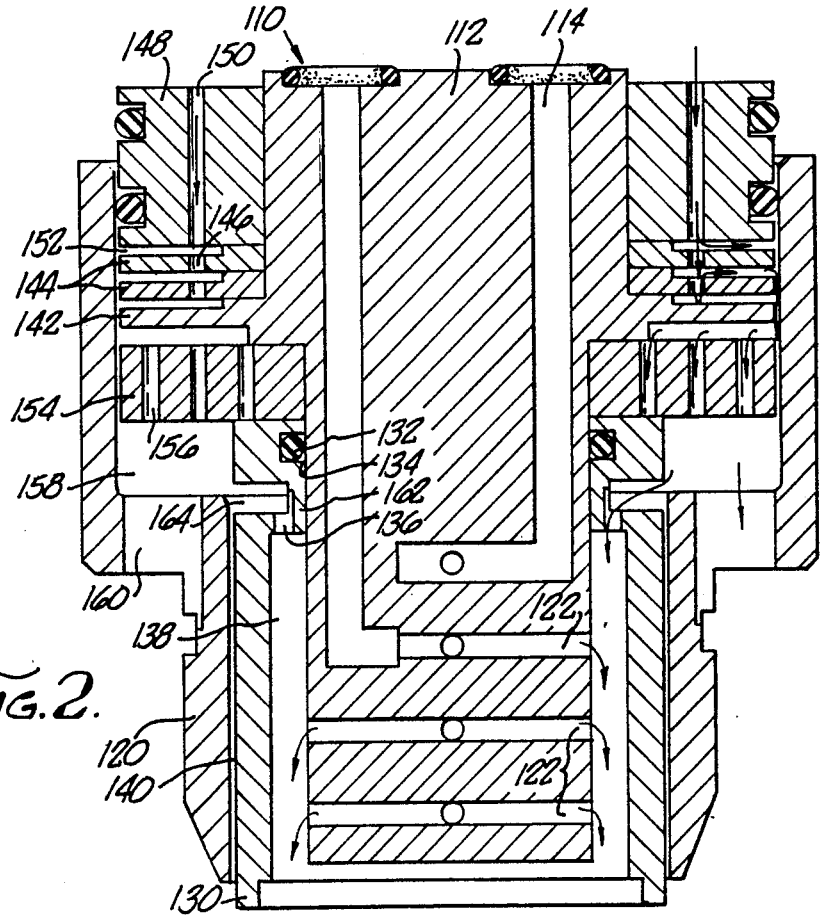
FIG. 2 is a side cross-sectional view of a second embodiment of the superflow diffuser and spout assembly of the present invention adapted to dispense syrups of different flavors.

Referring to the drawings, a superflow diffuser and spout assembly made in accordance with the present invention is shown in FIG. 1. The superflow diffuser and spout assembly 10 includes a body 12 and a spout 14. The body 12 is preferably integral with the spout 14 or the spout 14 may be a separate component attachable to the body 12. The body 12 is substantially cylindrical in shape, whereas the spout 14 is over an upper portion cylindrical in shape and over a lower portion substantially frustoconical.

The body 12 has a plurality of channels 16 formed in the lower portion of the body 12 circumferentially disposed around the spout 14. The channels 16 are positioned such that a first ridge 18 and a second ridge 20 formed along the outside wall of the spout 14 are operative to create turbulence in the liquid, as well as distribute an even flow of liquid around the entire perimeter of the spout 14; the liquid flowing along the outside surface of the spout 14. The purpose and importance of these ridges 18, 20 will be discussed in greater detail hereinafter in a discussion of the operation of the present invention. The spout 14 is formed such that an angled surface 22 is located at the lowermost portion of the spout 14 resulting in the substantially frustoconical configuration of the lower portion of the spout 14. The angled surface 22 directs the flow along the outside of the spout 14 into the flow passing through the inside of the spout 14 causing mixing of the two streams of liquid.

Fitted within the body 12 of the superflow diffuser and spout assembly 10 is a first disk 24 which has a groove 26 disposed about its entire periphery. The groove 26 houses an O-ring 28 to retain the first disk 24 within the body 12 and to seal the inner cavity of the body 12 from the outside environment. A second groove 30 is located along the upper surface of the disk 24 and houses a second O-ring 32 which is operative to seal the superflow diffuser and spout assembly 10 when it is attached to other components of a dispensing apparatus (not shown).

Extending upwardly from the disk 24 and integral therewith is a cylinder 34 which fits into the dispensing assembly (not shown) when the superflow diffuser and spout 10 is in position for use. The cylinder 34 includes multiple screw holes 36 into which are receivable screws to attach the first disk 24 to a second disk, which will be described in greater detail hereinafter.

A plurality of carbonated water inlets 38 are located within the cylinder 34 and are operative to receive carbonated water from a source (not shown). A syrup inlet 40 is located substantially in the center portion of the cylinder 34 and is attachable to a source of syrup (not shown) existing in the dispensing apparatus.

Also located within the body 12 is a second disk 42 which is fitted snugly within the body 12 such that minimal flow is permitted between the periphery of the disk 42 and the inside wall of the body 12. The disk 42 is provided with a plurality of channels 44 connecting the cavity 46 with the cavity 48. Substantially in the center portion of the disk 42 are threaded channels 50 which receive the screws (not shown) which pass through the channels 36. Thus, the first disk 24 is rigidly attachable to the second disk 42, the resulting assembly being insertable into the body 12.

In the preferred embodiment the second disk 42 is provided with numerous channels 44 which are equally spaced in a radially disposed position along the surface of the disk 42. Substantially in the center of the disk 42 is a center channel 52 which is substantially the same diameter as a channel 54 defined within the center portion of the first disk 24. Receivable into the channels 52, 54 is a syrup distributor and mixing assembly, which will be described in greater detail hereinafter.

Disposed between the first disk 24 and the second disk 42 are the plurality of diffuser elements 60 which are fitted about a cylindrical downwardly extending portion 62 of the first disk 24. The diffuser elements 60 are provided with a plurality of radially disposed channels 64 which are operative to permit passage of a portion of the carbonated water from the inlets 38 through the diffuser elements 60. The diffuser elements 60 are slightly smaller in diameter than the inside diameter of the body 12 such that a small annular passage is provided between the periphery of the diffuser elements 60 and the inner wall of the body 12.

A terminal diffuser 66 is also fitted about the cylindrical portion 62, however, the terminal diffuser 66 does not have any channels defined along its surface. Rather, all flow must pass outside of the periphery of the terminal diffuser 66 between the outer edge of the terminal diffuser 66 and the inner wall of the body 12.

The diffusers 60, 66 are maintained in a substantially parallel, yet separated, alignment by the affixing of the first disk 24 to the second disk 42 by the screws (not shown). It should be appreciated that although the preferred embodiment illustrates two diffuser elements 60 and a terminal diffuser 66 additional diffuser elements or other various forms of diffuser assemblies may be used without departing from the spirit of the present invention. It should also be appreciated that the diffuser elements 60 may be provided with slots, in addition to the channels, or other configurations of grooves or baffles to direct the flow of carbonated water within the chamber 46.

Fitted within the channel 52 and channel 54 is a syrup distributor 70 which is operative to direct syrup from the syrup input 40 into the interior of the spout 14. The syrup distributor 70 has a substantially vertical cylindrical section 72 extending upwardly from the body 74 of the syrup distributor 70 and adapted to fit snugly into the channel 52 and channel 54. Depending on relative pressures, soda from channel 52 may leak into the syrup in channel 80 or vice versa. An O-ring 76 is located within a groove 78 formed along the periphery of the cylinder 72 to prevent syrup from leaking into the channel 52 or to prevent soda in channel 52 from leaking into channel 80. The O-ring 76 also assists in snugly holding the syrup distributor 70 into the cylindrical portion 62 of the first disk 24.

The syrup distributor 70 has a channel 80 located substantially in the center of the body 74 which is in alignment with the syrup supply 40. A plurality of channels 82 open to the channel 80 are located substantially at the lower portion of the body 74 to direct the flow of syrup uniformly in multiple directions within the spout 14. Extending outwardly from the body 74 is a third disk 84 which is also provided with a plurality of radially disposed channels 86 which permit controlled and limited flow of the carbonated water from the chamber 48 into the interior chamber 88 of the spout 14.

In assembling the superflow diffuser and spout assembly of the present invention the diffuser elements 60 and terminal diffuser 66 are fitted about the cylindrical portion 62. When this is accomplished, the second disk 42 is affixed to the first disk 24 by the screws (not shown). The entire assembly consisting of the first disk 24, the diffuser elements 60, the terminal diffuser 66, and the second disk 42 is then attached to the dispensing apparatus by screws (not shown) from the lower side of the second disk 42. After this has been accomplished the cylinder 72 of the syrup distribution 70 is then fitted into the channels 52, 54. The entire assembly is then covered by the body 12.

In the preferred embodiment of the superflow diffuser and spout assembly 10 of the present invention the carbonated water inlet channels 38 are approximately 0.063 of an inch in diameter. In the preferred embodiment eight of the channels 38 are located within the cylinder 34. The channels 64 provided in the diffuser elements 60 are approximately 0.070 of an inch in diameter and number eight. The diffuser elements 60 are approximately 0.050 of an inch thick and a gap of approximately 0.030 of an inch exists between each of the diffuser elements 60. Approximately a 0.010 to 0.020 of an inch gap exists between the periphery of the diffuser elements 60 and the periphery of the terminal diffuser 66 and the inner wall of the body 12. Approximately a 0.055 of an inch gap exists between the lower surface of the terminal diffuser 66 and the upper surface of the second disk 42. The second disk 42 is provided with a plurality of channels 44 which are approximately 0.082 of an inch in diameter. The channels 86 are approximately 0.060 of an inch in diameter. It has been found that this configuration will result in flow rates of approximately 6 ounces per second at a carbonated water pressure of approximately 100 PSIG.

It should be appreciated that although the preferred embodiment of the present invention has been discussed in great detail above, other forms of diffusers can be located in the flow path of the carbonated water without departing from the spirit of the present invention. Consequently, although the present invention contemplates the use of a first disk 24, a second disk 42, a plurality of diffuser elements 60 and a terminal diffuser 66 other embodiments can be devised which accomplish the same function without departing from the spirit of the present invention. Furthermore, other types of flow separators can be located within the cavity 48 to separate the flow of the carbonated water such that a portion of the carbonated water flows through the channels 16 and a portion of the carbonated water flows through the channels 86. Alternatively, all of the carbonated water flow can be directed either outside the spout 12 or inside the spout 12. It is the separation or direction of the flow of carbonated water within the diffuser and spout assembly which achieves the desired result not the precise configuration which results in the separated or directed flow.

The use of the superflow diffuser and spout assembly of the present invention will permit mixed soft drinks to be dispensed at flow rates of at least 6 ounces per second with a 5:1, or variable, finished drink mixture ratio of carbonated water to syrup. By varying the size and number of the channels located within the cylinder 34, the diffuser elements 60 and the second disk 42 varying flow rates can be achieved.

The operation of the superflow diffuser and spout assembly of the present invention will now be discussed. It should be appreciated that the superflow diffuser and spout assembly of the present invention includes a diffuser of a unique design such that it drops the pressure of the carbonated water in a series of multiple stages.

The carbonated water initially enters the first disk 24 through the channels 38. A first pressure drop occurs within the channels 38. As the carbonated water flows through the channels 38 it enters the upper portion of the cavity 46 above the first diffuser element 60 wherein another pressure drop occurs. The carbonated water then passes through the channels 64 which function as capillaries to permit passage of a portion of the carbonated water through the diffuser elements 60. These channels 64 provide another stage of pressure reduction and their diameter and number may be varied depending upon the exact flow rate range and pressure reduction that is to be achieved.

Another stage of pressure reduction occurs as the carbonated water passes through a number of small chambers that are located between the diffuser elements 60 and the terminal diffuser 66. A portion of the carbonated water is allowed to flow radially outward where it must pass through several restricted annular spaces created between the periphery of the diffuser elements 6 and the terminal diffuser 66 and the inner wall of the body 12. Since there are no channels located within the terminal diffuser 66 all carbonated water must pass between the periphery of the terminal diffuser 66 and the inner wall of the body 12. This passage of carbonated water around the terminal diffuser 66 effectuates additional reduction in pressure of the carbonated water.

Another unique feature of the present invention is that a cross-current effect occurs within the diffuser section. This cross-current effect occurs because a portion of the carbonated water will pass through the channels 64 and a portion of the carbonated water will flow outwardly along the upper surfaces of the diffuser elements 60 and the terminal diffuser 66. As the carbonated water passes through the channels 64 it strikes the upper surface of the terminal diffuser 66 and is redirected back through the channels 64 thus increasing the cross-current effect and flooding the cavity 46. Furthermore, the stream of carbonated water flowing radially along the upper surface of the diffuser elements 60 and terminal diffuser 66 will collide with the flow of carbonated water passing along the inside wall of the body 12 to create additional pressure reduction. Because of this cross-current effect additional substantial pressure drop occurs within the diffuser section of the present invention.

When the flow of carbonated water about the outside edges of the diffuser elements 60 meets the outward flow along the top of the terminal diffuser 66 additional pressure drop is provided. The diameter of the diffuser elements 60 and 66 preferably have the same O.D. dimension to occasion a balancing of the flow.

To further dissipate the velocity of the carbonated water, as the carbonated water passes around the edge of the terminal diffuser 66 it is allowed to expand into the lower portion of the chamber 46 between the terminal diffuser 66 and the second disk 42. In this manner the carbonated water floods the lower portion of the chamber 46. The carbonated water then drops through the large number of channels 44 defined within the second disk 42. In the preferred embodiment it should be pointed out that the areas between the first disk 24 and the diffuser elements 60 and the terminal diffuser 66 are smaller than the area between the terminal diffuser 66 and the second disk 42. It has been determined that this results in a more balanced flooding of all areas between the diffuser elements 60 and the terminal diffuser 66.

Another stage of pressure drop occurs as the carbonated water passes through the multitude of channels 44 in the second disk 42. By sizing the channels 44 in accordance with desired flow rates and carbon dioxide retention, pressure drop of the carbonated water may be controlled. Yet another stage of pressure drop occurs as the carbonated water passes through the channels 44 and into the cavity 48. At this point the carbonated water is separated into two streams which occasions additional pressure drop. A first stream flows through the channels 16 defined within the lower portion of the body 12 and located about the spout 14. A second portion of the stream is diverted through the channels 86 defined within the disk 84 and is allowed to flow into the chamber 88 within the spout 14. Thus, another stage of pressure drop is achieved by passage of the carbonated water through the channels 16 and through the channels 86 into the chamber 88. Alternatively, all of the carbonated water flow may be directed to the outside of the spout 14 or into the spout 14. The gradual reduction of pressure and velocity of the carbonated water stream is essential to minimizing foaming and maximizing the carbonation retention level of the finished drink.

It should be appreciated that in the preferred embodiment a greater volume of carbonated water is permitted to pass through the channels 16 than through the channels 86. It has been determined that only a small portion of the carbonated water need pass through the channels 86 and into the inner portion of the spout 14 to effectuate proper mixing with the syrup dispensed by the syrup distributor 70. The blending that occurs within the interior of the spout 1 in the chamber 88 is the first stage of carbonated water/syrup mixing and results in little foaming since only a small quantity of the carbonated water is allowed to gently mix with the syrup. The configuration of the spout 14 permits another stage of pressure drop to occur as the carbonated water enters the chamber 88. An additional benefit of the present invention is that the carbonated water is allowed to rinse the spout 14 and thus cleanse the chamber 88 of any residual syrup.

The body 12 and spout 14 configuration of the present invention is also of unique design. The body 12 and spout 14 configuration allows most of the carbonated water, at the time that it passes through the channels 16 and meets the carbonated water flowing through the spout 14, to be substantially at atmospheric pressure. The channels 16 are larger than the channels 44 located within the second disk 42 but there are fewer of the channels 16 located about the periphery of the spout 14. These channels 16 allow the carbonated water to be broken up into many large streams that flow on the outside surface of the spout 14 and cling to the surface of the spout 14. To assist in the clinging of the stream to the spout 14, the spout 14 may be provided with a set of very fine serrations (not shown) along the outer surface of the spout 14. These serrations assist in causing the stream of carbonated water to follow closely to the surface of the spout 14. However, it should be appreciated that the serrations are not necessary providing the spout 14 is constructed with the grooves 18, 20 described below.

The spout 14 is designed such that a further reduction in the energy flow of the carbonated water is occasioned as the carbonated water leaves the second disk 42 and fills the area between the second disk 42 and the floor of the pouring spout 14. At the bottom of the spout 14 some of the water/syrup mixture collides with the streams of water coming down along the outside of the spout 14 through the channels 16, thus reducing the energy of the carbonated water.

As the carbonated water streams through the channels 16 of the body 12, the velocity of the water stream is further reduced by grooves 18, 20 located just below the channels 16 of the body 12. These grooves 18, 20 allow the many streams along the outside periphery of the spout 14 to blend into a single solid stream around the full periphery of the spout 14. This blending into a single stream eases the mixing of the syrup and carbonated water at the bottom of the spout 14.

The channels 16 also allow the carbon dioxide that has escaped, as a result of the lowering of the pressure of the carbonated water, to vent to the atmosphere without contacting the syrup. Thus, the foaming of the end product is substantially reduced. As stated earlier, it is known that carbon dioxide contacting the syrup is a major cause of foaming, as well as the relative velocity of the two fluids, that is the syrup and the carbonated water, blending together.

A further advantage of the present invention is that as the carbonated water flows down the outside of the spout 14 a small amount of the carbon dioxide is lost to the atmosphere and is thus prevented from mixing with the syrup. Also, the stream flowing along the outside of the spout 14 is slowed by the surface of the spout 14 departing from conventional spout assemblies which provide limited contact with the stream of carbonated water. Also, as the stream passes through the channels 16 and along the outside of the spout 14 it converges and blends with the carbonated water/syrup stream flowing through the chamber 88 and additional mixing is occasioned at the lower portion of the spout 14. Thus, dilution of the concentrated carbonated water/syrup stream by the first water stream passing along the outside of the spout 14 is done and the resultant confluence of the first stream and the second stream results in a gentle blending of the streams and additional mixing of the syrup with the carbonated water to result in a higher quality drink.

A second embodiment of the present invention illustrates a superflow diffuser and spout assembly 110 that is designed to be used with a plurality of different flavored syrups. In this second embodiment the superflow diffuser and spout assembly 110 includes a syrup distributor 112 which has a plurality of channels 114 which are operative to introduce different flavored syrups into the interior of the spout 120. The syrups are dispensed through a series of independent channels 122 which are spaced apart and thus permit dispensing of different flavors of syrup through one syrup distributor 112.

The superflow diffuser and spout assembly 110 includes a special shroud 130 which is fitted into the inner portion of the spout 120 and is retained within the spout 120 by locating the shroud 130 about the periphery of the syrup distributor 112. Retaining the shroud 130 within the spout 120 is accomplished by the use of an O-ring 132 located within a groove 134. The shroud 130 has a plurality of channels 136 defined substantially within its upper portion to permit the introduction of carbonated water into the cavity 138 located between the outer periphery of the syrup distributor 112 and the inner wall of the shroud 130. A small annular channel 140 is present between the outer wall of the shroud 130 and the inner wall of the spout 120.

In this second embodiment the syrup distributor 112 has an outwardly extending terminal diffuser 142 integral with the syrup distributor 112. A plurality of diffuser elements 144 containing channels 146 are located between the terminal diffuser 142 and the first disk 148. The first disk 148 includes a series of channels 150 which are operative to introduce carbonated water into the cavity 152.

A second disk 154 containing a plurality of channels 156 is fitted below the terminal diffuser 142 and defines a second chamber 158 which opens into a plurality of channels 160, whereby the flow of carbonated water through the superflow diffuser and spout assembly 110 is diverted into two streams, one stream passing through the plurality of channels 160 the other stream passing through the plurality of channels 136.

The shroud 130 has a recessed portion 162 which defines a chamber 164 which results in a slightly longer "after-flow" to accomplish rinsing of the syrup from the mixing area to minimize flavor carryover. A controlled and limited portion of the carbonated water will flow through the channels 136 thus resulting in mixing of the carbonated water with the syrup flowing through the channels 122. An even smaller portion of the carbonated water will flow into the annular channel 140 between the outer periphery of the shroud 130 and the inner wall of the spout 120. This annular channel 140 carries a small portion of the carbonated water, without being mixed with the syrup, to effectuate rinsing of the pouring spout 120. The close fit between the shroud 130 and the spout 120 permitting only limited flow is effective to wash away any remaining syrup residue on the bottom edge of the shroud 130.

It should be appreciated that in the superflow diffuser and spout assembly 110 of the second embodiment a similar number of pressure drops are occasioned by the use of multiple chambers, diffuser elements and channels. Thus, the resulting carbonated water passing through the channels 160 is substantially at atmospheric pressure at the time that it passes along the outside of the spout 120 and mixes with the blended carbonated water/syrup mixture flowing through the shroud 130 and spout 120.

It should also be appreciated that a shroud may be used with the single flavor superflow diffuser and spout assembly 10 of the present invention, whereby the shroud can be located within the spout 14 to occasion washing of the spout of any residual syrup and reduction in the velocity of the distributed syrup resulting in a more gentle mixing of the syrup and carbonated water to reduce foaming. Furthermore, it should be appreciated that various configurations of channels may be located about the outside of the spout in either the first embodiment or the second embodiment to control the flow of carbonated water on the outside of the spout and thus vary the flow rate and mixing of the carbonated water/syrup.

It will be obvious to those skilled in the art that various changes may be made without departing from the spirit of the present invention, and therefore the invention is not limited to what is shown in the drawings and described in detail in this specification but only as indicated in the appended claims.

We claim:

1. A superflow diffuser and spout assembly for use with a liquid dispensing apparatus, comprising:

a body, an inlet in said body for receiving a supply of carbonated water, an inlet in said body for receiving a supply of syrup, a diffuser assembly in said body through which at least a portion of said carbonated water supply passes prior to being dispensed, a spout attached to said body, a flow separator within the path of said carbonated water supply, a syrup distributor in said spout, wherein said flow separator is operative to separate said carbonated water supply into at least two streams, a first stream directed to flow along an outside surface of said spout, a second stream directed to flow through said spout, wherein said second stream flowing through said spout mixes with syrup distributed from said syrup distributor, wherein said first stream of carbonated water and said second stream of carbonated water, then mixed with syrup, meet for dispensing.

2. The superflow diffuser and spout assembly of claim wherein said diffuser assembly comprises;

a plurality of diffuser elements having a series of channels defined therein.

3. The superflow diffuser and spout assembly of claim 1 wherein said syrup distributor is operative to introduce a plurality of different syrup flavors independently into said spout.

4. The superflow diffuser and spout assembly of claim 1 or 3 which includes a shroud located within said spout, said shroud operative to effect cleaning of said spout of residual syrup.

5. A superflow diffuser and spout assembly for use with a liquid dispensing apparatus, comprising:

a first disc, said first disc having a plurality of channels defined therein for transporting a carbonated water flow, a second disc, said second disc having a plurality of channels defined therein for transporting said carbonated water flow, a diffuser assembly, said diffuser assembly having a plurality of channels defined therein for transporting said carbonated water flow, said diffuser assembly being located between said first and said second disk, a body, a spout, said spout attached to said body, said body including a plurality of channels, said plurality of body channels operative to transport carbonated water, said plurality of body channels being positioned with respect to said spout to cause flow of carbonated water along an outside surface of said spout, a syrup distributor, said syrup distributor operative to introduce syrup into said spout, means for separating said carbonated water flow into a first stream of carbonated water passing through said body channels and a second stream of carbonated water passing into said spout, whereby said second stream of carbonated water mixes with said syrup introduced into said spout, and said first stream of carbonated water flowing outside said spout eventually meets said second stream of carbonated water, then mixed with syrup, passing through said spout for dispensing.

6. The superflow diffuser and spout assembly of claim 5 wherein said syrup distributor is operative to introduce a plurality of different flavored syrups into said spout.

7. The superflow diffuser and spout assembly of claim 6 which includes a shroud operative to effectuate rinsing of said spout.

8. A superflow diffuser and spout assembly fcr use with a liquid dispensing apparatus, comprising:

a body, a spout attached to said body, a first disc, said first disc including a plurality of channels, a second disc, said second disc including a plurality of channels, a diffuser assembly, said diffuser assembly comprising a plurality of discs, said diffuser discs having a plurality of channels, a terminal diffuser disc, said terminal diffuser disc operative to flood a chamber in which said diffuser discs are located, said diffuser assembly and said terminal disc being located between said first disk and said second disk, a plurality of channels defined within said body, said body channels located about the periphery of said spout, said spout including a groove positioned below said body channels, a syrup distributor, said syrup distributor operative to introduce syrup into said spout, a flow separator, said flow separator operative to separate a flow of carbonated water within the superflow diffuser and spout assembly into at least a first and second stream of carbonated water, said first stream of carbonated water flowing through said body channels along an outside surface of said spout, said second stream of carbonated water flowing into the interior of said spout, said second stream of carbonated water directed to meet and collide with said syrup introduced into said spout to occasion mixing of said carbonated water and said syrup, said first stream flowing along said outside surface of said spout and said second stream of carbonated water, including syrup, converging at a lower portion of said spout for dispensing.

9. The superflow diffuser and spout assembly of claim 8 wherein said syrup distributor is operative to introduce a plurality of different flavored syrups independently into said spout.

10. The superflow diffuser and spout assembly of claim 8 or 9 which includes a shroud located within said spout, said shroud operative to effectuate cleansing of said spout.

11. A superflow diffuser and spout assembly for use with a liquid dispensing apparatus, comprising:

a body an inlet in said body for receiving a supply of carbonated water, an inlet in said body for receiving a supply of syrup, a diffuser assembly in said body through which said carbonated water supply passes prior to being dispensed, a spout, said spout attached to said body, a flow diverter within the path of said carbonated water supply, a syrup distributor, wherein said flow diverter is operative to direct said carbonated water supply along an outside surface of said spout, said carbonated water supply and said syrup supply meeting to form a single stream for dispensing.

12. A superflow diffuser and spout assembly for use with a liquid dispensing apparatus, comprising:

a body, an inlet in said body for receiving a supply of carbonated water, an inlet in said body for receiving a supply of syrup, a diffuser assembly through which said carbonated water supply passes prior to being dispensed, said diffuser assembly operative to provide a plurality of pressure reduction locations along the flow path of said carbonated water supply, said diffuser assembly comprising:

a first disk, a second disk, a plurality of diffuser elements each having a plurality of channels located therein, a terminal diffuser element, said diffuser elements and said terminal diffuser element positioned between said first and second disk, a spout, a syrup distributor, wherein said carbonated water supply mixes with said syrup supply distributed into said spout from said syrup distributor for dispensing.

13. A liquid dispensing apparatus including a superflow diffuser and spout assembly, comprising:

a body, an inlet for receiving a supply of diluent, an inlet for receiving a supply of beverage concentrate, a diffuser assembly, said diffuser assembly in fluid communication with said diluent supply, a spout, means for separating said diluent supply into at least two portions, a beverage concentrate distributor, said beverage concentrate distributor in fluid communication with said beverage concentrate supply, said beverage concentrate distributor adapted to transport beverage concentrate into said spout, means for directing a first portion of said diluent supply into contact with said beverage concentrate, means for directing a second portion of said diluent supply outside of said spout.

14. The liquid dispensing apparatus including a superflow diffuser and spout assembly of claim 13 which includes means for directing said first portion of diluent supply into contact with said second portion of diluent supply then mixed with beverage concentrate for dispensing.

15. A liquid dispensing apparatus including a superflow diffuser and spout assembly, comprising:

a body, a spout, said spout attached to said body, a diffuser assembly, said diffuser assembly located within said body, a beverage concentrate distributor located within said spout, a beverage concentrate inlet, said beverage concentrate inlet adapted to transport beverage concentrate to said beverage concentrate distributor, a diluent inlet, said diluent inlet adapted to transport at least a portion of a diluent supply through said diffuser assembly, a flow separator, said flow separator adapted to separate said diluent supply into at least two portions, a first of said portions of said diluent supply directed to flow through a passage adapted to transport said diluent into contact with said beverage concentrate, a second of said portions of said diluent supply directed to flow through a second passage adapted to transport said diluent outside of said spout, said first portion of diluent supply and said second portion of diluent supply mixed with beverage concentrate being directed by said spout into contact for dispensing.

16. A superflow diffuser and spout assembly for use with a dispensing apparatus, comprising:

a body including a spout, a diffuser assembly located within said body, a diluent supply, a beverage concentrate supply, a beverage concentrate distributor adapted to transport said beverage concentrate supply into said spout, means for transporting a portion of said diluent supply through said diffuser assembly, means for separating said diluent supply after it has passed through said diffuser assembly into at least first and second portions, said first portion being diverted into said spout to mix with said beverage concentrate supply, said second portion being diverted outside cf said spout, said first and second portions directed to flow into a container.

17. A method for dispensing a post-mixed beverage comprising the steps of:

introducing a diluent supply into a body, transporting said diluent supply through a diffuser assembly located within said body, introducing a beverage concentrate supply into said body, distributing said beverage concentrate supply into a spout attached to said body, separating said diluent supply into at least first and second portions, directing said first diluent portion into said spout to mix with said beverage concentrate supply, directing said second diluent portion outside of said spout.

18. A uniform quality post-mixed beverage made by a process comprising the steps of:

introducing a supply of diluent into a body, transporting said diluent supply through a diffuser assembly located within said body, introducing a supply of beverage concentrate into said body, distributing said beverage concentrate supply into a spout attached to said body, separating said diluent supply into at least first and second portions, directing said first diluent portion into said spout to mix with said beverage concentrate supply, directing said second diluent portion outside of said spout.

19. A dispensing apparatus including a superflow diffuser and spout assembly, comprising:

a valve body, a diluent inlet in said valve body, a beverage concentrate inlet in said valve body, a spout attached to said valve body, a beverage concentrate distributor in fluid communication with said beverage concentrate inlet, said beverage concentrate distributor adapted to direct beverage concentrate into said spout, a diffuser, said diffuser in fluid communication with said diluent inlet, a flow separator, said flow separator in fluid communication with said diluent inlet, said flow separator adapted to direct a first portion of diluent along an outside surface of said spout, said flow separator adapted to direct a second portion of diluent into said spout.

* * * * *

US004928854B1

REEXAMINATION CERTIFICATE (4029th)

United States Patent [19] [11] B1 4,928,854

McCann et al. [45] Certificate Issued Apr. 4, 2000

[54] SUPERFLOW DIFFUSER AND SPOUT ASSEMBLY

[75] Inventors: Gerald P. McCann, Los Angeles; Andrew J. Holoubek, Burbank, both of Calif.

[73] Assignee: McCann's Engineering and Manufacturing Co., Los Angeles, Calif.

Reexamination Request:
No. 90/005,149, Oct. 16, 1998

Reexamination Certificate for:

| | |
|---|---|
| Patent No.: | **4,928,854** |
| Issued: | **May 29, 1990** |
| Appl. No.: | **07/195,947** |
| Filed: | **May 19, 1988** |

[51] Int. Cl.[7] ..... B67D 5/56; B05B 15/02

[52] U.S. Cl. ..... 222/129.1; 222/145; 222/148; 239/106; 239/419.3; 239/432

[58] Field of Search ..... 222/129.1, 129.2, 222/129.3, 129.4, 148, 481, 488, 145; 239/419.3, 419, 422, 424, 427.3, 427.5, 432, 106

[56] References Cited

U.S. PATENT DOCUMENTS 4,808,346 2/1989 Strenger ..... 261/18.1

*Primary Examiner*—Kevin P. Shaver

[57] ABSTRACT

A superflow diffuser and spout assembly includes an inlet for carbonated water, an inlet for syrup, a diffuser assembly through which the carbonated water passes prior to being dispensed, a spout, a syrup distributor, and a flow separator within the path of the carbonated water, the flow separator being operative to separate the carbonated water into at least two streams, one stream directed to flow along an outside surface of the spout, the second stream directed to flow inside the spout, the second stream colliding with and mixing with syrup distributed within the spout, wherein the first stream of carbonated water and the second stream of carbonated water, then mixed with syrup, meet and form a single stream for dispensing. A second embodiment includes a syrup distributor having a plurality of inlets for different flavored syrups and a shroud located within the spout between the syrup distributor and an inner surface of the spout. The shroud may be adapted for use with the single syrup flavor embodiment of the present invention.

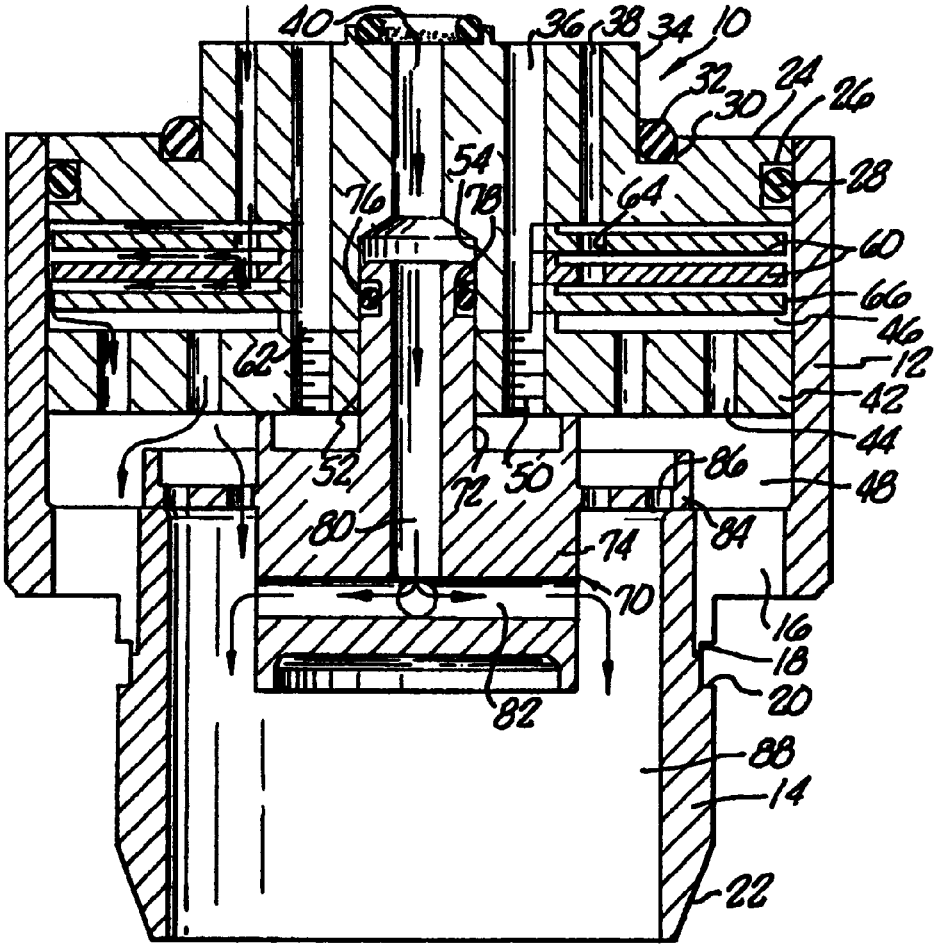

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 5–10, and 12 is confirmed.

Claims 1, 2, 11, 13 and 15–19 are determined to be patentable as amended.

Claims 3, 4 and 14, dependent on an amended claim, are determined to be patentable.

1. A superflow diffuser and spout assembly for use with a liquid dispensing apparatus, comprising:

a body, an inlet in said body for receiving a supply of carbonated water, an inlet in said body for receiving a supply of syrup, a diffuser assembly in said body through which at least a portion of said carbonated water supply passes prior to being dispensed, a spout attached to said body *and including an outside surface which extends outside of the body and is exposed to atmosphere*, a flow separator within the path of said carbonated water supply, a syrup distributor in said spout, wherein said flow separator is operative to separate said carbonated water supply into at least two streams, a first stream directed to flow along [an] *said* outside surface of said spout *exposed to atmosphere*, a second stream directed to flow through said spout, wherein said second stream flowing through said spout mixes with syrup distributed from said syrup distributor, wherein said first stream of carbonated water and said second stream of carbonated water, then mixed with syrup, meet for dispensing.

2. The superflow diffuser and spout assembly of claim *1* wherein said diffuser assembly comprises;

a plurality of diffuser elements having a series of channels defined therein.

11. A superflow diffuser and spout assembly for use with a liquid dispensing apparatus, comprising:

a body an inlet in said body for receiving a supply of carbonated water, an inlet in said body for receiving a supply of syrup, a diffuser assembly in said body through which said carbonated water supply passes prior to being dispensed, a spout, said spout attached to said body *and including an outside surface which extends outside of the body and is exposed to atmosphere*, a flow diverter within the path of said carbonated water supply, a syrup distributor, wherein said flow diverter is operative to direct said carbonated water supply *both inside and* along [an] *said* outside surface of said spout *exposed to atmosphere*, said carbonated water supply and said syrup supply meeting to form a single stream for dispensing.

13. A liquid dispensing apparatus including a superflow diffuser and spout assembly, comprising:

a body, an inlet for receiving a supply of diluent, an inlet for receiving a supply of beverage concentrate, a diffuser assembly, said diffuser assembly in fluid communication with said diluent supply, a spout *including an outside surface which extends outside of the body and is exposed to atmosphere,* means for separating said diluent supply into at least two portions, a beverage concentrate distributor, said beverage concentrate distributor in fluid communication with said beverage concentrate supply, said beverage concentrate distributor adapted to transport beverage concentrate into said spout, means for directing a first portion of said diluent supply into contact with said beverage concentrate, means for directing a second portion of said diluent supply outside of said spout *along said outside surface exposed to atmosphere.*

15. A liquid dispensing apparatus including a superflow diffuser and spout assembly, comprising:

a body, a spout, said spout attached to said body *and including an outside surface which extends outside of the body and is exposed to atmosphere*, a diffuser assembly, said diffuser assembly located within said body, a beverage concentrate distributor located within said spout, a beverage concentrate inlet, said beverage concentrate inlet adapted to transport beverage concentrate to said beverage concentrate distributor, a diluent inlet, said diluent inlet adapted to transport at least a portion of a diluent supply through said diffuser assembly, a flow separator, said flow separator adapted to separate said diluent supply into at least two portions, a first of said portions of said diluent supply directed to flow through a passage adapted to transport said diluent into contact with said beverage concentrate, a second of said portions of said diluent supply directed to flow through a second passage adapted to transport said diluent outside of said spout *along said outside surface exposed to atmosphere*, said first portion of diluent supply and said second portion of diluent supply mixed with beverage concentrate being directed by said spout into contact for dispensing.

16. A superflow diffuser and spout assembly for use with a dispensing apparatus, comprising:

a body including a spout *having an outside surface which extends outside of the body and is exposed to atmosphere*, a diffuser assembly located within said body, a diluent supply, a beverage concentrate supply, a beverage concentrate distributor adapted to transport said beverage concentrate supply into said spout, means for transporting a portion of said diluent supply through said diffuser assembly, means for separating said diluent supply after it has passed through said diffuser assembly into at least first and second portions, said first portion being diverted into said spout to mix with said beverage concentrate supply, said second portion being diverted outside of said spout *along said outside surface exposed to atmosphere*, said first and second portions directed to flow into a container.

17. A method for dispensing a post-mixed beverage comprising the steps of:

introducing a diluent supply into a body, transporting said diluent supply through a diffuser assembly located within said body, introducing a beverage concentrate supply into said body, distributing said beverage concentrate supply into a spout attached to said body, separating said diluent supply into at least first and second portions, directing said first diluent portion into said spout to mix with said beverage concentrate supply, directing said second diluent portion outside of said spout *along an outside surface of said spout which extends from said body and is exposed to atmosphere.*

18. A uniform quality post-mixed beverage made by a process comprising the steps of:

introducing a supply of diluent into a body, transporting said diluent supply through a diffuser assembly located within said body, introducing a supply of beverage concentrate into said body, distributing said beverage concentrate supply into a spout attached to said body, separating said diluent supply into at least first and second portions, directing said first diluent portion into said spout to mix with said beverage concentrate supply, directing said second diluent portion outside of said spout *along an outside surface of said spout which extends from said body and is exposed to atmosphere.*

19. A dispensing apparatus including a superflow diffuser and spout assembly, comprising:

a valve body, a diluent inlet in said valve body, a beverage concentrate inlet in said valve body, a spout attached to said valve body *and including an outside surface which extends outside of said body and is exposed to atmosphere*, a beverage concentrate distributor in fluid communication with said beverage concentrate inlet, said beverage concentrate distributor adapted to direct beverage concentrate into said spout, a diffuser, said diffuser in fluid communication with said diluent inlet, a flow separator, said flow separator in fluid communication with said diluent inlet, said flow separator adapted to direct a first portion of diluent along [an] *said* outside surface of said spout *exposed to atmosphere*, said flow separator adapted to direct a second portion of diluent into said spout.

* * * * *